United States Patent [19]

Walker

[11] 3,944,187

[45] Mar. 16, 1976

[54] ROADWAY IMPACT ATTENUATOR

[75] Inventor: Grant W. Walker, Sacramento, Calif.

[73] Assignee: Dynamics Research and Manufacturing, Inc., Sacramento, Calif.

[22] Filed: Sept. 13, 1974

[21] Appl. No.: 505,636

[52] U.S. Cl. ..... 256/13.1; 256/1

[51] Int. Cl.[2] ..... A01K 3/00

[58] Field of Search ..... 256/1, 13.1; 188/404; 114/219

[56] References Cited

UNITED STATES PATENTS

| | | | |
|---|---|---|---|
| 2,265,698 | 12/1941 | Opgenorth | 256/13.1 |
| 2,898,090 | 8/1959 | Rasmussen | 256/13.1 |
| 3,210,051 | 10/1965 | Case | 256/13.1 |
| 3,468,567 | 9/1969 | Attwood et al. | 256/13.1 |
| 3,666,055 | 5/1972 | Walker | 256/13.1 |

FOREIGN PATENTS OR APPLICATIONS

| | | | |
|---|---|---|---|
| 432,573 | 8/1966 | Switzerland | 256/13.1 |

*Primary Examiner*—Paul R. Gilliam
*Assistant Examiner*—Doris L. Troutman
*Attorney, Agent, or Firm*—Lothrop & West

[57] ABSTRACT

A roadway impact attenuator adapted to be installed between lanes on a highway or in advance of a barrier on the highway includes a number of substantially identical units each of which has a framework slidably resting on the ground or pavement, and spaced from the barrier or from a similar framework. An energy converting means is disposed between the barrier and the framework. The framework is related to the ground by a ground anchor secured thereto and releasably connected to the framework. Additionally, overlapped side panels are mounted generally horizontally along the sides of the framework, being secured thereto and being secured to similar panels on other frameworks in a telescoping relationship.

7 Claims, 4 Drawing Figures

ROADWAY IMPACT ATTENUATOR

There is an increasing need to provide a barrier or attenuator for use along highways and the like, either in front of abutments or between highway lanes, in order that crashing vehicles can readily and safely be arrested and kept to their own side or within their own lane on the highway, and can be kept from impacting superstructures, barriers and the like which are adjacent thereto. The aim is to provide an arrangement which is substantially self-contained during an impact and does not release all sorts of loose portions which may in themselves become missiles and cause damage, and which also is sufficiently supported and contained as to preclude excessive injury to impacting vehicles or to people. Furthermore, a proper impact attenuator should be relatively cheap to restructure and restore after an impact, and should serve as a guide or director for glancing blows, as well as for head-on blows. The means used for absorbing or converting the energy of the crash should be relatively harmless, cheap, serviceable in all weather and quite quickly and readily be replaced.

A suitable energy converting cell for this purpose is shown in U.S. Pat. No. 3,666,055, issued May 30, 1972, and entitled "Energy Absorbing Device." That device is a generally cylindrical cast or molded body of vermiculite or comparable material usually enclosed in a light casing and particularly wrapped with a helical wire, so that upon impact the vermiculite is converted to a relatively fine powder and does not release any large particles. It is a general aim hereof to provide an impact attenuator which can utilize such an energy conversion unit in a superior fashion.

It is therefore an object of the invention to provide a roadway impact attenuator that has all of the features and virtues outlined above.

Another object of the invention is to provide a roadway impact attenuator effective to convert with a relatively small movement a large amount of energy.

Another object of the invention is to provide a roadway impact attenuator that can quite readily be installed on existing roadways by present crews and with presently available maintenance people and equipment in a simple, economical and effective fashion.

Another object of the invention is to provide a roadway impact attenuator that is generally an improvement over comparable devices currently available.

Other objects together with the foregoing are attained in the embodiments of the invention described in the accompanying description and illustrated in the accompanying drawing, in which.

Figure 1:
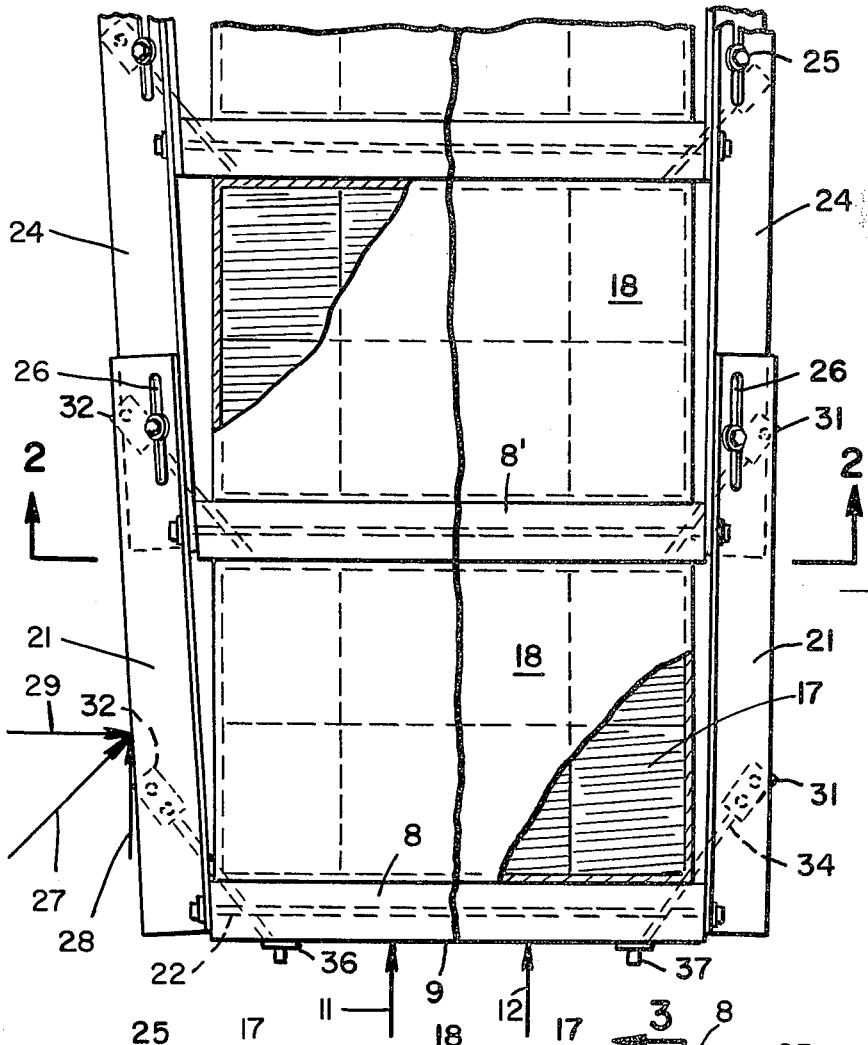
FIG. 1 is a plan of a portion of a roadway impact attenuator pursuant to the invention, there being a division line in the center to indicate a rather widely flaring construction on the left side and a relatively straight construction on the right side.

While the roadway impact attenuator can be embodied in a large number of different forms, and can be installed variably in accordance with surrounding conditions, it is typically exemplified as shown herein for installation on a roadway 6. This is assumed to have the customary pavement, in which instance there is especially provided, if necessary, a pad 7 of concrete or the like, which is referred to herein as the ground, since the composition of the supporting surface is not particularly important, save only that the surface be relatively horizontal and planar throughout.

Adapted to rest on the surface or ground 7 is a framework 8. The framework 8 is usually a generally rectangular box having an impact face 9 extending generally normal to one direction of impact illustrated by the arrows 11 and 12 in FIG. 1. The framework can be made of a number of joined metal channels open, for example, on one side so that the framework can be filled to provide a solid wall extending thereacross. Preferably embedded in the filling material, such as concrete, is a pair of legs 13 and 14. These extend for substantially the entire height of the framework and project therefrom below the lower edge to end in glides 16 designed to rest upon and to slide easily upon the pad 7. Thus, the framework is mounted for sliding movement on the ground.

Disposed between the framework 8 and any barrier behind it, such as a similar framework 8', is a plurality of energy converting cells 17 of the sort shown in the abovementioned patent. These are preferably arranged side-by-side with their axes horizontal, preferably in the direction 11 and 12 and are disposed on top of each other and behind each other. They are conveniently secured usually in a surrounding corrugated cardboard enclosure or carton 18 itself supported from the ground 7 by a plurality of pedestals 19.

The framework 8 and adjacent frameworks of a like nature, such as the framework 8', are preferably provided along their sides with a particular panel construction. There is afforded on the leading framework (considered in the direction of the arrows 11 and 12) a primary side panel 21 which conveniently is of a corrugated material, such as relatively light sheet metal, arranged in a generally horizontal direction and fastened by means of through bolts 22. These extend through the framework and mount the primary side panel thereon, there being a pair of primary panels one at each side of the framework.

Additionally, each of the side panels secured to the framework 8 frictionally engages at its trailing end a similar secondary panel 24 secured to the next adjacent framework, such as 8', so that each side panel at least at one end is directly secured to its associated framework. Furthermore, the side panels of the primary and secondary type have their corrugations interfitting and overlapping each other at least in part. The overlapping portions are provided with slots 26 at least in the uppermost corrugations, and through each pair of such slots there is disposed a fastening 25, such as a nut and bolt assembly, tightened to a reasonable degree. The primary and secondary panels, in the event of impact, can slide on each other or are arranged to telescope with respect to each other.

Finally, all of the impacts are by no means head on in the direction of the arrows 11 and 12, and some may not even have major components in such direction, but rather take place from one side as illustrated by the arrow 27 in FIG. 1. In these events there are components 28 parallel to the arrows 11 and 12 but there are also components 29 normal or at right angles thereto. It is of great importance that such glancing or side impacts, as represented by the arrow 27, be well resisted. For that reason, and to keep the various frameworks in approximate original alignment, there is provided a securing means. Fastened into the ground, preferably into a concrete panel 7, for each framework is a pair of ground anchors 31 and 32, arranged behind the face 9 of the particular framework 8 being described, and also arranged alongside such framework. Each ground anchor is secured to its mounting by fastenings 33 and is connected by a somewhat flexible rod or cable 34 diagonally to the side and to the rear and joins a hook 36 preferably in the form of a ring. This can readily be slipped over a corresponding pin 37 projecting forwardly from the face 9, counter to the direction of the arrows 11 and 12.

With the arrangement shown, there is provided on the left of FIG. 1 substantially the same structure as is shown on the right half of that figure except that the side panels overlap each other at more nearly divergent angles on the left than is the case in connection with the right-hand side. The right-hand side is particularly designed for a median use or between oppositely directed lanes of a highway so that the general width of the attenuator does not substantially change throughout a relatively long length. However, the form on the left half of FIG. 1 with the wider divergence is particularly designed to fit in front of a barrier such as a post or wall, and is generally tapered as seen in plan. It may be understood that any one impact attenuator may have both sides widely diverging as on the left half of FIG. 1, or substantially straight as on the right half of FIG. 1, or can in some instances include an arrangement as shown, with one side widely diverging and the other side substantially straight or parallel.

In the general operation of this arrangement, in the event there is a head-on impact as shown by the arrows 11 and 12, say against a face 9, whether or not such face has a forward tapered cone (which is largely for appearance sake), the impact moves the framework 8 rearwardly in the direction of the arrows 11 and 12, since the framework can slide rather readily on the ground 7 and in itself not counted upon to convert much energy. Such rearward movement of the framework tends to load and disintegrate the vermiculite material in the energy converter's cells 17 which also oppose the force but move generally rearwardly. This framework movement is accompanied by telescopic movement of the primary and secondary side panels, and is likewise accompanied, in the event it is of sufficient extent, by disengagement of the pins 36 withdrawing from within the hook rings 37. This allows the energy converting cells to do substantially all of the energy conversion, the pin and hook connection to the ground anchor being primarily to maintain the framework in position normally against lateral dislodgement.

In the event the impact is a glancing one, as illustrated by the arrow 27 in FIG. 1, then the rearward component 28 acts just as described, but the lateral component 29 tends to dislodge the frameworks laterally and this is not desired. Under such circumstances, the frameworks are substantially restrained throughout a large amount of their rearward movement and against lateral displacement by reason of the fact that the hooks or rings are still effective laterally as long as they are in engagement with their pins. Thus, the frameworks cannot easily be dislodged sideways upon an initial impact. However, if the rearward component is great enough, there is then a disengagement of the hook rings from the pins and the energy conversion proceeds from one framework to the next, each framework moving rearwardly as the energy conversion cells behind it are loaded and disintegrate.

The parts of the framework and anchor structure do not themselves convert substantial energy, leaving most of that job to the vermiculite cells, so that in many cases the frameworks and side panels can easily be restored to their initial condition for re-use. If they are too badly damaged, they can easily be removed by unbolting some of the side panel fastenings and replaced with fresh units. After an impact, it is easy for the various frameworks to be restored to their initial position, to be rehooked to the ground anchors and for new energy conversion cells to be installed either individually or in their containing boxes 18. The frictionally telescoping side panels also have substantial energy converting effects often without themselves being unduly distorted or damaged.

Actual high-speed crash tests of structures of the sort as shown herein have demonstrated plainly that the device remains substantially self-contained even after severe frontal or glancing impacts, is effective to reduce the speed of the impacting object very promptly, does not require any special technique or service in order to be restored, does not severely injure the impacting object, and in general affords a greatly improved arrangement for maintaining safe conditions against impact along a roadway.

Under some circumstances, the energy converting cells, comparable in some respects to the cells 17, are of a highly particular characteristic. This may be very loosely associated vermiculite particles or, in an elementary version, may be simply sacks 40 or containers of sand. Such particles act somewhat like fluids and unless the framework 8 is especially restrained it may tend, upon a frontal impact, to ride up and over the sand or sand bags thus losing much of its frictional or braking resistance upon the ground and perhaps dissipating the sand over a wide area, an undesirable and perhaps dangerous result.

Figure 4:
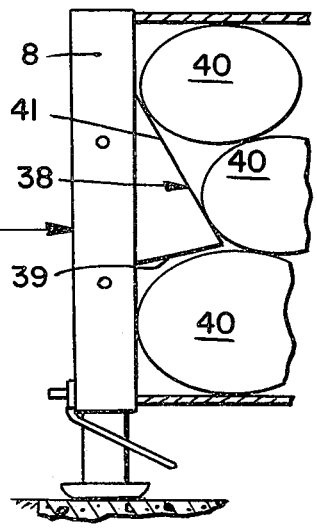
FIG. 4 is a view like FIG. 3 but showing a modified form of the attenuator.
Figure 2:
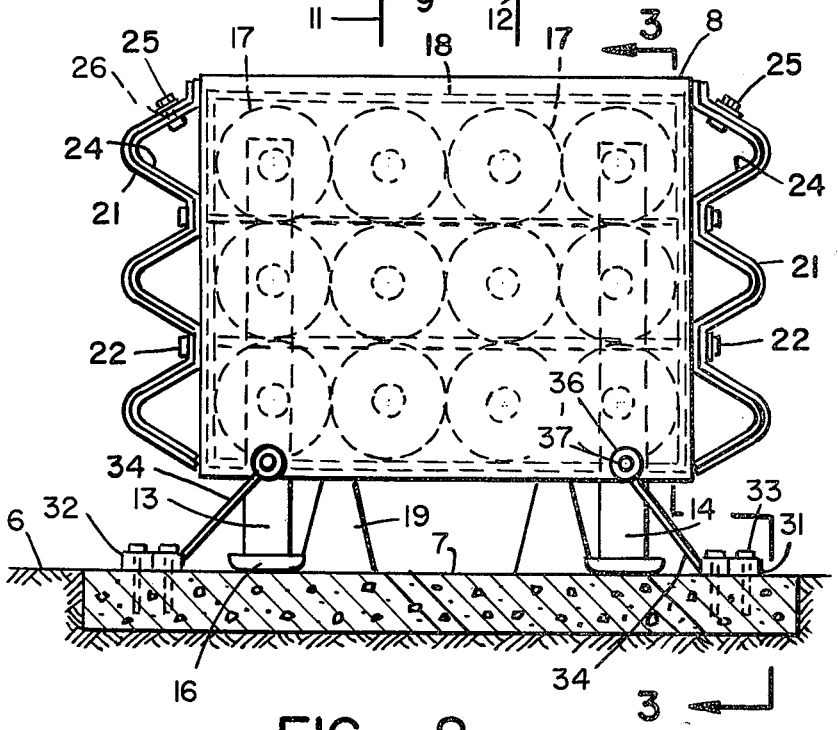
FIG. 2 is a cross-section, the plane of which is indicated by the line 2—2 of FIG. 1.
Figure 3:
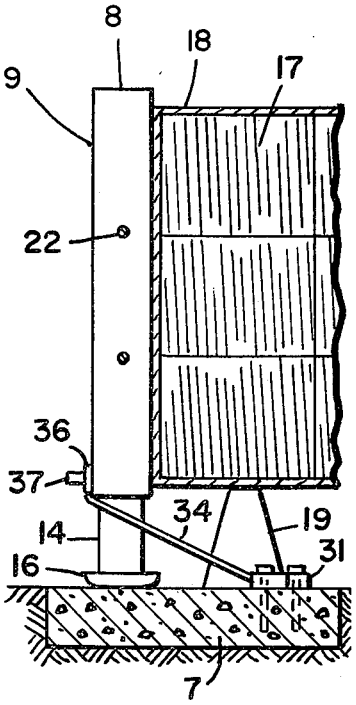
FIG. 3 is a fragmentary view illustrating in cross-section in the line 3—3 of FIG. 2, the general construction shown in FIGS. 1 and 2.

To avoid or reduce these and other difficulties, I preferably equip each one or more of the frameworks 8 with a deflector 38 (FIG. 4). Conveniently this is made of a sheet of metal bent into a horizontal, dihedral form with the lower plate 39 close to horizontal to act as a brace and to have little or no effective lifting component when encountering sand. The upper plate 41 is inclined at an angle having a large downward component when entering sand. The deflector 38 has two main functions. When driven into sand or the like it presents a desirable downward force through the framework onto the ground. Deflection of sand tends to be upwardly and forwardly in an inoffensive area ahead of the framework. The horizontal and vertical components of the forces acting through the deflector can be varied as desired by varying the angles of the deflector plates 38 and 39.

What is claimed is:

1. A roadway impact attenuator adapted to be supported on the ground on which traffic advances in a predetermined direction comprising a framework, means for supporting said framework perpendicular to said direction and for sliding movement on the ground in said direction, a barrier perpendicular to said direction and separated from said framework to leave a space therebetween, a disintegrating energy converting means in said space and interposed between said barrier and said framework, a ground anchor, and means releasable by movement of said framework in said direction connecting said ground anchor to said framework.

2. A device as in claim 1 in which said releasable means includes a pin projecting from said framework in said direction, and a hook engaging said pin and removable therefrom by movement in said direction and joined to said ground anchor.

3. A device as in claim 1 including a primary side panel, means for securing said primary side panel detachably to the side of said framework, a secondary side panel, and means for interconnecting said secondary side panel and said primary side panel for relative telescoping movement in said direction.

4. A device as in claim 3 in which said primary side panel and said secondary side panel are corrugated in the direction of said telescoping movement, and said interconnecting means is disposed away from the exposed ridges of said corrugations.

5. A device as in claim 1 in which said framework has a transverse face disposed to receive an impact in said predetermined direction, said impact having a component normal to said transverse face, and in which said ground anchor is disposed to one side of said framework and on the side of said framework away from said face in said direction.

6. A device as in claim 1 including a deflector on said framework having a plate extending transversely to said predetermined direction and affording a substantial downward component of a horizontal force acting against said deflector in said predetermined direction.

7. A device as in claim 1 in which said releasable means releases only by movement of said framework in said direction.

* * * * *